US008376639B2

(12) United States Patent
Ferrara et al.

(10) Patent No.: US 8,376,639 B2
(45) **Date of Patent: *Feb. 19, 2013**

(54) SUBSTRATE MEDIA REGISTRATION AND DE-SKEW APPARATUS, METHOD AND SYSTEM

(75) Inventors: Joseph J. Ferrara, Webster, NY (US); Joseph M. Ferrara, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/466,219

(22) Filed: May 8, 2012

(65) Prior Publication Data

US 2012/0219343 A1 Aug. 30, 2012

Related U.S. Application Data

(63) Continuation of application No. 12/371,110, filed on Feb. 13, 2009, now Pat. No. 8,206,048.

(51) Int. Cl.
*B41J 11/00* (2006.01)

(52) U.S. Cl. ..... 400/579; 400/578

(58) Field of Classification Search ..... 400/579
See application file for complete search history.

(56) References Cited

U.S. PATENT DOCUMENTS

| | | | | |
|---|---|---|---|---|
| 5,034,781 | A | 7/1991 | Watanabe | |
| 7,319,842 | B2 * | 1/2008 | Koyanagi et al. | 399/395 |
| 8,206,048 | B2 * | 6/2012 | Ferrara | 400/579 |
| 2004/0251607 | A1 | 12/2004 | Mandel et al. | |
| 2005/0058493 | A1 | 3/2005 | Kida | |
| 2005/0087578 | A1 | 4/2005 | Jackson | |
| 2006/0104687 | A1 | 5/2006 | Campbell et al. | |
| 2006/0163801 | A1 | 7/2006 | Dejong et al. | |

* cited by examiner

*Primary Examiner* — Michael G Lee
*Assistant Examiner* — Matthew Mikels

(57) ABSTRACT

According to aspects described herein, there is disclosed an apparatus for de-skewing substrate media in a printing system. The apparatus including and idler roller and a drive roller. The idler roller for engaging substrate media. The drive roller cooperating with the idler roller to form a nip assembly for moving the substrate media in a process direction. The drive roller rotatably supported on a shaft axis by a first bearing element and a second bearing element. The first and second bearing elements disposed remote from one another along the shaft axis. The shaft axis pivotally supported at the first bearing element for aligning the shaft axis with a substrate media skew. The shaft axis configured to pivot about a pivot axis perpendicular to the shaft axis and extending through the first bearing element.

20 Claims, 2 Drawing Sheets

SUBSTRATE MEDIA REGISTRATION AND DE-SKEW APPARATUS, METHOD AND SYSTEM

CROSS-REFERENCE TO RELATED APPLICATIONS

This application claims priority and is a continuation of U.S. patent application Ser. No. 12/371,110 filed on Feb. 13, 2009, the disclosure of which is incorporated herein in its entirety by reference.

INCORPORATION BY REFERENCE

The following U.S. patent application is further incorporated in its entirety for the teachings therein: U.S. Patent and Trademark Office application Ser. No. 12/364,675, filed Feb. 3, 2009, entitled MODULAR COLOR XEROGRAPHIC PRINTING ARCHITECTURE, assigned to the assignee hereof.

TECHNICAL FIELD

The presently disclosed technologies are directed to an apparatus, method and system of registering and de-skewing a substrate media in a substrate media handling assembly, such as a printing system.

BACKGROUND

In a printing system, accurate and reliable registration of the substrate media as it is transferred in a process direction is desirable. Even a slight skew or misalignment of the substrate media through an image transfer zone can lead to image and/or color registration errors. For example, in printing systems transporting substrate media using nip assemblies or belts, slight skew of the substrate media can cause processing errors. Also, as substrate media is transferred between sections of the printing system, the amount of skew can increase or accumulate. In modular overprint systems, the accumulation of skew will translate into substrate media positioning errors between module exit and entry points, particularly in a cross-process direction. Such errors can cause large push, pull or shearing forces to be generated, which transmit to the substrate media being transported. Medium and light-weight substrate media cannot generally support large forces, which will cause wrinkling, buckling or tearing of such media.

Accordingly, it would be desirable to provide an apparatus, method and system of registering and de-skewing a substrate media, which overcomes the shortcoming of the prior art.

SUMMARY

According to aspects described herein, there is disclosed an apparatus for de-skewing substrate media in a printing system. The apparatus includes at least one sensor for measuring skew of the substrate media being transferred relative to a process direction. The apparatus also includes a nip assembly for moving the substrate media in the process direction. The nip assembly includes a drive roller and an idler roller for engaging the substrate media. The drive roller is rotatably supported on a shaft axis, with the shaft axis being pivotally supported substantially at one end thereof for aligning the shaft axis with the measured substrate media skew. The shaft axis pivots about a pivot axis perpendicular to the shaft axis.

According to other aspects described herein, there is provided an apparatus for de-skewing substrate media in a printing system, wherein the nip assembly can pivot about the pivot axis. Also, the apparatus can further include an actuating member for pivoting the shaft axis about the pivot axis to an orientation parallel to an edge of the substrate media. Additionally, the actuating member can be disposed substantially at an opposed end of the shaft axis relative to the pivotal support. Further, the actuating member can include a cam assembly. Further still, the at least one sensor can include at least two sensors disposed ahead of the nip assembly in the process direction. Yet further still, the at least two sensors can be spaced apart in a cross-process direction, wherein a straight line between the two sensors is parallel to the shaft axis in a default position. The pivotal support can include a spherical bearing element. Also, both the actuating member and the sensor can be coupled to a control system for actuating the nip assembly in response to a sensor measurement. The idler roller can be biased toward the drive roller.

According to further aspects described herein, there is provided a method of de-skewing substrate media in a printing system. The method includes measuring a skew angle of a substrate media transferred in a process direction. Then, pivoting an axis of rotation of a registration nip assembly to match the skew angle. The axis of rotation pivots about a support disposed laterally to a centerline of the process direction. Upon engagement of the substrate media with the registration nip assembly, then pivoting the axis of rotation to a position perpendicular to the process direction.

According to yet further aspects described herein, the method can also include disengaging a further nip assembly from the substrate media prior to pivoting the axis of rotation to a position perpendicular to the process direction. Also, the further nip assembly can be disposed upstream to the registration nip assembly relative to the process direction. Additionally, the axis of rotation can be translated in a cross process direction. Further, the substrate media velocity can be measured and adjusted. Further still, the skew angle of the substrate media can be measured from an edge of the substrate media prior to engagement with the nip assembly. The pivoting of the axis of rotation can be controlled by a cam assembly. Also, the cam assembly can be actuated by a motor in response to the skew angle measurement. The registration nip assembly axis of rotation can pivot about a spherical bearing assembly. The skew angle measurement can be performed by at least one sensor disposed upstream to the nip assembly in the process direction. The spherical bearing assembly can be disposed at an opposite side of the nip assembly from a cam assembly.

DETAILED DESCRIPTION

Describing now in further detail these exemplary embodiments with reference to the Figures, as described above the substrate media registration and de-skew apparatus and method are typically used in a select location or locations of the paper path or paths of various conventional printing assemblies. Thus, only a portion of an exemplary printing system path is illustrated herein.

As used herein, a "printer" or "printing system" refers to one or more devices used to generate "printouts" or a print outputting function, which refers to the reproduction of information on "substrate media" for any purpose. A "printer" or "printing system" as used herein encompasses any apparatus, such as a digital copier, bookmaking machine, facsimile machine, multi-function machine, etc. which performs a print outputting function.

A printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, or other substrates on which information can be reproduced, preferably in the form of a sheet or web.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, "skew" refers to a physical orientation of a substrate media relative to a process direction. In particular, skew refers to a misalignment, slant or oblique orientation of an edge of the substrate media relative to a process direction.

As used herein, the terms "process" and "process direction" refer to a process of printing or reproducing information on substrate media. The process direction is a flow path the substrate media moves in during the process. A "cross-process direction" is lateral to the process direction.

Figure 1:
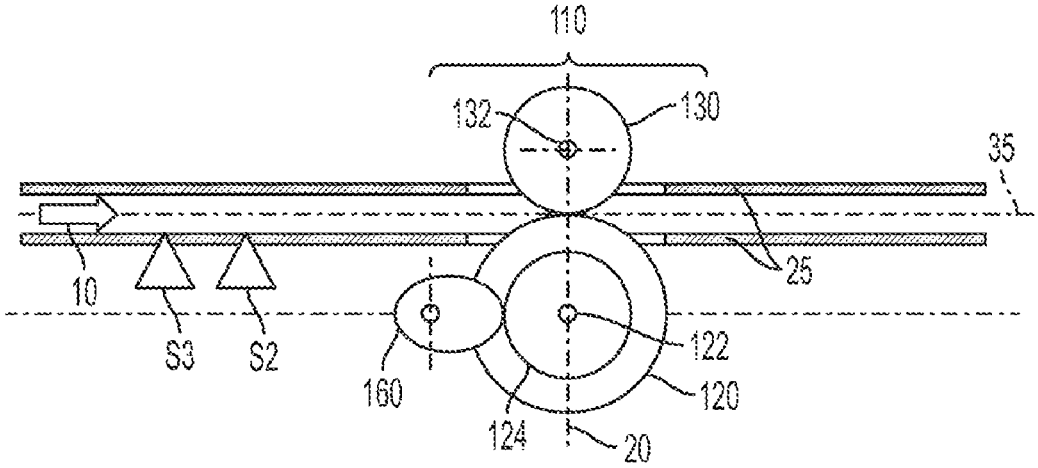
FIG. 1 is a partially schematic side view of a substrate media registration and de-skew apparatus for use with a printing system.

FIG. 1 depicts a partially schematic side view of a substrate media registration and de-skew apparatus for use with a substrate media handling system, preferably for a printing system. It should be noted that the partially schematic drawings herein are not to scale. In FIG. 1, arrow 10 represents the direction of flow of the substrate media, which corresponds to the process direction, from an upstream location toward a downstream location. In this way, the substrate media travels across a registration and de-skew area where a nip assembly 110 is located. Two baffles 25 are preferably provided above and below the substrate media path 10. Preferably, the baffles are equidistantly spaced away from a substrate media centerline 35 and act as guides for the substrate media as it approaches and moves beyond the nip assembly 110 in the flow direction 10.

Figure 2:
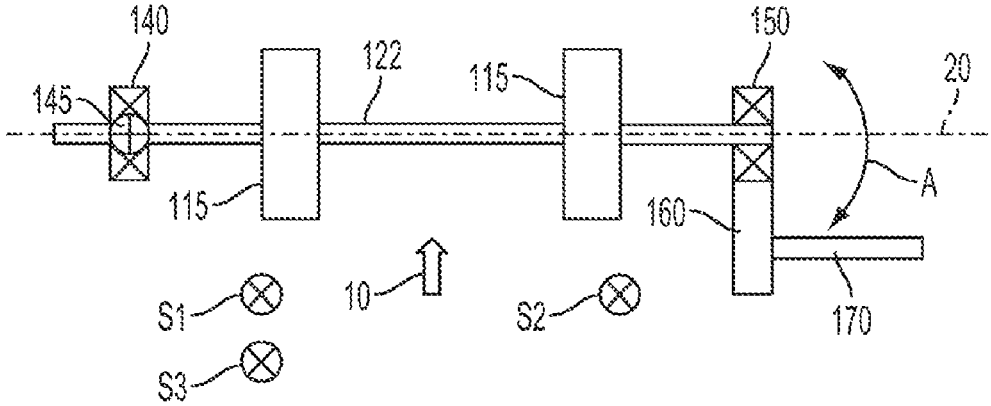
FIG. 2 is a partially schematic plan view of a substrate media registration and de-skew apparatus for use with a printing system.
Figure 3:
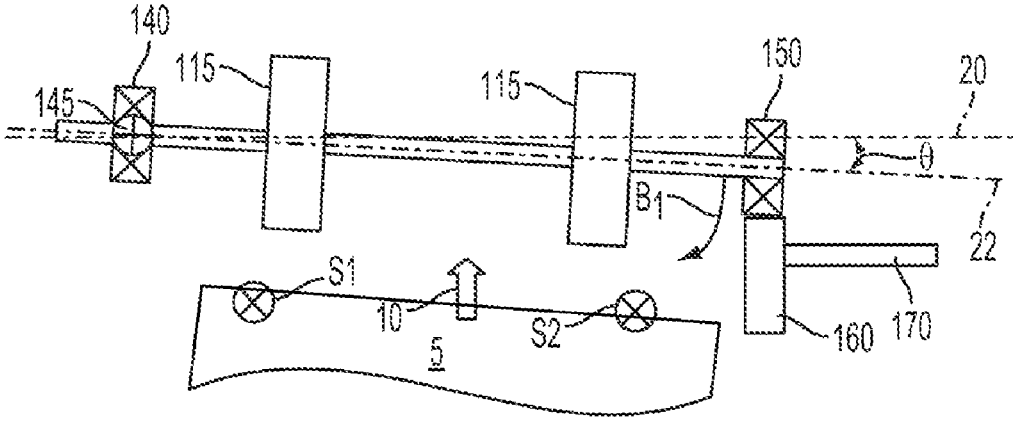
FIG. 3 is a partially schematic plan view of the apparatus of FIG. 2, with a nip assembly skewed to substantially conform to a handled substrate media.
Figure 4:
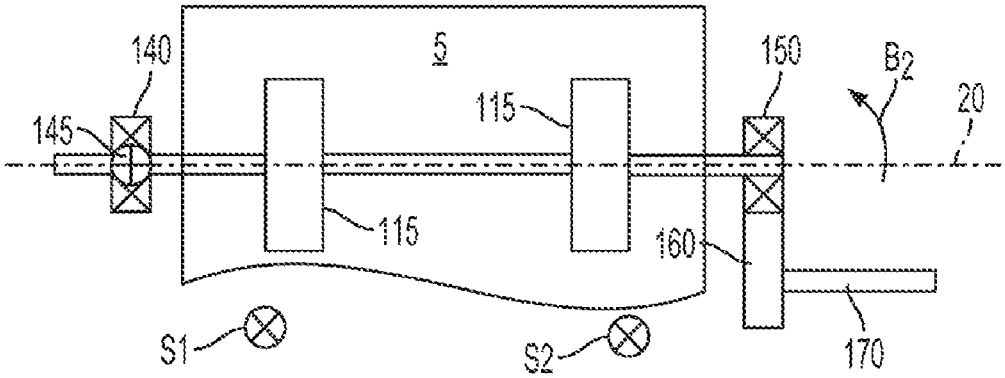
FIG. 4 is a partially schematic plan view of the apparatus of FIG. 3, with the nip assembly and substrate media adjusted to a default position.

Preferably, each nip 115 includes a drive roll 120 and an idler 130. The drive roll 120 and idler 130 of the nip tend to touch one another along a contact line. Thus, the nip 115 is used to engage and grab substrate media and moves it through the overall assembly. While not shown, a spring is preferably center loaded against the idler shaft 132 biasing the driver roll 120 and idler 130 toward one another, thus supplying a gripping force for the nips 115. The default position for the drive shaft 122 and the idler shaft 132 is in a plane 20, which is preferably perpendicular to the flow path 10. Also, preferably the drive shaft 122 and the idler shaft 132 are supported in a parallel configuration in that common registration plane 20 when in the default position. The registration plane 20 vertically traverses the substrate media flow path 10. Preferably, the drive rolls 120 from each nip 115 are supported by a common drive shaft 122. Similarly, the idlers 130 from each nip 115 are supported by a common idler shaft 132. Thus, at least the drive rolls 120, drive shaft 122, idlers 130 and idler shaft 132 are considered part of an overall nip assembly 110. As shown in FIGS. 2-4, more than one nip 115 is preferably supported by the drive shaft 122 and the idler shaft 132. Also, a cam follower 124 is preferably supported by the drive shaft 122. The cam follower 124 is adapted to be engaged with a cam 160. The cam 160 is used as an actuating member to alter the orientation or angle of the nip assembly 110 in the direction of flow 10. Preferably, the drive shaft 122 is biased toward the cam 160.

FIG. 2 is a partially schematic plan view of the apparatus shown in FIG. 1. The two nips 115 are spaced apart laterally across the flow path 10. For illustrative purposes, the drive shaft 122 alone is shown in the plan view drawings herein, as it is understood that the drive shaft 122 and idler shaft 132 preferably remain parallel. The drive shaft 122 is supported by bearings 140, 150 that allow the drive shaft 122 to rotate freely along its axis. The cam 160 can shift the position of the inboard bearing 150. The cam 160 is supported by a cam shaft 170 that is driven by a motor, which is preferably a stepper motor (not shown). The outboard bearing 140 preferably differs from inboard bearing 150 in that the outboard bearing 140 includes a spherical bearing element 145 that in addition to axial rotation, provides for pivotal movement A of the drive shaft 122. In this way, as the cam 160 is rotated, the inboard side of the nip assembly 110 will move in an arch A in either the upstream or downstream direction, depending on how the cam 160 is rotated. When the inboard side pivots, the outboard side of the nip assembly 110 pivots about spherical bearing element 145. Thus, the nip assembly pivots about a pivot axis centered on the spherical bearing element 145, which pivot axis is perpendicular to both the process direction and the cross-process direction. The idler shaft 132 is supported in such a way that it will follow and remain parallel to the drive shaft 122 as it pivots. For example, in inboard side of the nip assembly 110 can be supported in an oval guide yoke (not shown), that allows the inboard bearing to float. The pivotal movement A of the nip assembly 110 is preferably controlled by turning the cam 160 a specific amount using the attached motor.

Upstream of the nip assembly 110 are sensors S1, S2, S3. The sensors S1, S2, S3 preferably detect the orientation of the substrate media as it approaches the registration and de-skew area. While two (2) to three (3) sensors are shown in FIGS. 2-4, it should be understood that fewer or greater numbers of sensors could be used, depending on the type of sensor, the desired accuracy of measurement and redundancy needed or preferred. For example, a pressure or optical sensor could be used to detect when the substrate media passes over each individual sensor. Additionally, the sensors can be positioned further upstream or closer to the registration and de-skew area as necessary. It should be appreciated that any sheet sensing system can be used to detect the position and/or other characteristics of the substrate media in accordance with the disclosed technologies.

In one embodiment shown in FIGS. 3 and 4, at least two sensors S1, S2 are provided that are spaced apart from one another in a parallel configuration relative to the drive shaft 122 default position, shown in FIG. 1. Preferably, these sensors S1, S2 are also parallel to other upstream/downstream processes, such as the photoreceptor(s) and the image transfer zone. Such parallel alignment of these sensors S1, S2 is preferably "zeroed out" during the set up of the overall assembly. Alternatively an automated mechanism can be provided for maintaining parallel alignment. The sensors S1, S2 will individually detect when they are blocked by the substrate media 5. By registering the difference in the time that sensors S1, S2 are blocked by the substrate media 5 and knowing the velocity, the skew of the substrate media 5 relative to registration plane 20 and relative to a downstream transfer zone can be measured. As shown in FIG. 1, where a third sensor S3 is positioned adjacent to S1 a known dimension downstream, the velocity of the substrate media 5 can be more accurately measured.

FIG. 3 shows a skewed substrate media 5 approaching the registration and de-skew area. As the substrate media 5 crosses the sensors S1, S2, the skew is measured and registered by automated control systems. Then, prior to the substrate media 5 arriving at the registration plane 20, the nip assembly 110, including the drive shaft 122 and idler shaft 132, is pivoted to match the measured skew. As shown in FIG. 3, the control system pivots the nip assembly 110 in direction $B_1$ by actuating the motor that controls the cam 160. During this pivotal movement, the drive shaft 122 and idler shaft 132 remain parallel to one another in a plane 22, which represents a nip assembly central plane. Once the nip assembly 110 is skewed to match the substrate media 5, the nip plane 22 will form an angel θ with the registration plane 20. Once the nip assembly 110 engages the substrate media 5, any additional upstream or downstream nips (not shown) are preferably opened. In this way, those additional nips release the substrate media 5 so it can be freely adjusted. The cam 160 can then be driven by the motor in direction $B_2$ back to its default position. FIG. 4 shows the nip assembly 110 in the default position. This pivotal rotation to the default position pulls or shifts the substrate media 5 substantially into alignment with the downstream transfer zone.

Alternatively, if the sensors S1, S2 detect that the incoming substrate media 5 is substantially aligned with the default position (no significant skew), then no de-skewing is preferably performed. The substrate media 5 can then proceed through the nip assembly and encouraged toward the downstream transfer zone without pivoting the drive shaft 122.

Additionally, regardless of whether the pivotal de-skewing is performed as described above, further cross-process positioning can occur once the substrate media 5 is engaged by the nip assembly 110. Also, process positioning and timing can also be adjusted in the registration and de-skew area. During any additional adjustment of the cross-process or process positioning or timing, the previous downstream nips are preferably opened to allow the substrate media 5 to be adjusted more freely. Functions such as cross-process positioning can be achieved by shifting sideways (lateral to the process direction 10) a substantial portion of the drive mechanism. Further sensors, such as edge sensor can be used to detect when the substrate media 5 is properly positioned. Any process positioning or timing can be accomplished though careful control of the drive shaft velocity.

Often printing systems include more than one printing module or station. Accordingly, more than one nip assembly 110 can be included in an overall printing system. Further, it should be understood that in a modular system or a system that includes more than one nip assembly 110, in accordance with the disclosed technologies herein, could detect substrate media position and relay that information to a central processor for controlling registration and/or skew in the overall printing system. Thus, if the registration and/or skew is too large for one nip assembly 110 to correct, then correction can be achieved with the use of more than one nip assembly 110, for example in another module or station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for de-skewing substrate media in a printing system, comprising:

an idler roller for engaging substrate media; and a drive roller cooperating with the idler roller to form a nip assembly for moving the substrate media in a process direction, the drive roller rotatably supported on a shaft axis by a first bearing element and a second bearing element, the first and second bearing elements disposed remote from one another along the shaft axis, the shaft axis pivotally supported at the first bearing element for aligning the shaft axis with a substrate media skew, the shaft axis configured to pivot about a pivot axis perpendicular to the shaft axis and extending through the first bearing element.

2. The apparatus of claim 1, wherein the first bearing element is disposed along the shaft axis from the drive roller toward a nearest of two opposed lateral edges of a process path over which the substrate media moves in the process direction.

3. The apparatus of claim 1, further comprising:

an actuating member for pivoting the shaft axis about the pivot axis to an orientation parallel to an edge of the substrate media, the actuating member disposed substantially at an opposed end of the shaft axis relative to the first bearing element.

4. The apparatus of claim 3, wherein the actuating member includes a cam assembly configured to engage a portion of the second bearing element for pivoting the shaft axis.

5. The apparatus of claim 1, further comprising:

at least one sensor for measuring skew of substrate media moving in a process direction, the at least one sensor disposed ahead of the nip assembly in the process direction.

6. The apparatus of claim 5, wherein the at least one sensor includes at least three sensors for additionally measuring substrate media speed.

7. The apparatus of claim 1, wherein the first bearing element includes a spherical bearing element, the shaft axis and the pivot axis extending through the spherical bearing element.

8. An apparatus for de-skewing substrate media in a printing system, comprising:

an idler roller for engaging substrate media; and a drive roller cooperating with the idler roller to form a nip assembly for moving the substrate media in a process direction along a process path, the drive roller rotatably supported on a shaft axis, the shaft axis pivotally supported substantially at one end thereof for aligning the shaft axis with a substrate media skew, the shaft axis configured to pivot about a pivot axis perpendicular to the shaft axis, portions of the process path over which the substrate media traverses while engaged by the nip assembly defining a nip engagement path, the pivot axis disposed entirely outside the nip engagement path.

9. The apparatus of claim 8, wherein the shaft axis is rotatably supported by a first bearing element and a second bearing element disposed remote from one another along the shaft axis, the pivot axis extending through the first bearing element.

10. The apparatus of claim 8, further comprising:

an actuating member for pivoting the shaft axis about the pivot axis to an orientation parallel to an edge of the substrate media, the actuating member disposed substantially at an opposed end of the shaft axis relative to the pivot axis.

11. The apparatus of claim 10, wherein the actuating member includes a cam assembly configured to engage a bearing element rotatably supporting the shaft axis.

12. The apparatus of claim 8, further comprising:

at least one sensor for measuring skew of substrate media moving in the process direction, the at least one sensor disposed upstream of the nip assembly in the process direction.

13. The apparatus of claim 12, wherein the at least one sensor includes at least three sensors for additionally measuring substrate media speed.

14. The apparatus of claim 8, wherein the pivotal support includes a spherical bearing element, the shaft axis and the pivot axis extending through the spherical bearing element.

15. A method of de-skewing substrate media in a printing system, comprising:

measuring a skew angle of a substrate media transferred in a process direction;

pivoting an axis of rotation of a drive roller in a registration nip assembly to match the skew angle, the drive roller rotatably supported on the axis of rotation by a first bearing element and a second bearing element, the first and second bearing elements disposed remote from one another along the shaft axis, the pivoting of the axis of rotation being about a pivot axis substantially perpendicular to the process direction and extending through the first bearing element;

engaging the substrate media with the drive roller; and pivoting the axis of rotation to a position substantially perpendicular to the process direction.

16. A method of de-skewing substrate media of claim 15, further comprising:

disengaging a further nip assembly from the substrate media prior to pivoting the axis of rotation to a position perpendicular to the process direction, the further nip assembly disposed upstream to the registration nip assembly relative to the process direction.

17. A method of de-skewing substrate media of claim 15, further comprising:

translating the axis of rotation in a cross process direction extending perpendicular to the process direction.

18. A method of de-skewing substrate media of claim 15, wherein the first bearing element is disposed along the shaft axis from the drive roller toward a nearest of two opposed lateral edges of a process path over which the substrate media moves in the process direction.

19. A method of de-skewing substrate media of claim 15, wherein portions of the process path over which the substrate media traverses while engaged by the nip assembly defining a nip engagement path, the pivot axis disposed entirely outside the nip engagement path.

20. A method of de-skewing substrate media of claim 15, wherein the first bearing element includes a spherical bearing element, the axis of rotation and the pivot axis extending through the spherical bearing element.

* * * * *